US009192976B2

(12) United States Patent
Yannone et al.

(10) Patent No.: US 9,192,976 B2
(45) Date of Patent: Nov. 24, 2015

(54) DRAW AND IRON APPARATUS

(71) Applicant: Rexam Beverage Can Company, Chicago, IL (US)

(72) Inventors: Joseph S. Yannone, Lake Waynoka, OH (US); Leo Hayden, Fox River Grove, IL (US); Peter C. Young, Marengo, IL (US)

(73) Assignee: Rexam Beverage Can Company, Chicago, IL (US)

( * ) Notice: Subject to any disclaimer, the term of this patent is extended or adjusted under 35 U.S.C. 154(b) by 185 days.

(21) Appl. No.: 13/738,734

(22) Filed: Jan. 10, 2013

(65) Prior Publication Data

US 2014/0190235 A1 Jul. 10, 2014

(51) Int. Cl.

| | |
|---|---|
| ***B21D 51/26*** | (2006.01) |
| ***B21D 22/30*** | (2006.01) |
| ***B21D 22/20*** | (2006.01) |
| ***B21D 22/28*** | (2006.01) |

(52) U.S. Cl.

CPC ..... *B21D 51/26* (2013.01); *B21D 22/20* (2013.01); *B21D 22/28* (2013.01); *B21D 22/286* (2013.01); *B21D 22/30* (2013.01)

(58) Field of Classification Search

CPC ..... B21D 22/28; B21D 22/30; B21D 51/26; B21D 22/20; B21D 22/286

USPC ..... 72/28, 241, 347, 248, 379, 379.4, 467, 72/715, 247, 348, 349; 413/69, 76

See application file for complete search history.

(56) References Cited

U.S. PATENT DOCUMENTS

| | | | |
|---|---|---|---|
| 3,656,335 | A | 4/1972 | Kaminski |
| 4,300,375 | A | 11/1981 | Maeder et al. |
| 4,554,815 | A | 11/1985 | Weishalla |

(Continued)

FOREIGN PATENT DOCUMENTS

| | | | |
|---|---|---|---|
| FR | 1531235 | A | 6/1968 |
| GB | 724251 | | 2/1955 |
| GB | 2112685 | A | 7/1983 |
| GB | 2301055 | A | 11/1996 |
| WO | 9101830 | A1 | 2/1991 |

OTHER PUBLICATIONS

Mandavian and Mai, Further Studies in Friction, Metallic Transfer and Wear Debris of Sliding Surfaces, pp. 35-44, 1984.*

(Continued)

*Primary Examiner* — Shelley Self
*Assistant Examiner* — Patrick Gunson
(74) *Attorney, Agent, or Firm* — Greer Burns & Crain, Ltd.; Peter M. Klobuchar

(57) ABSTRACT

An apparatus for forming a container body from a metal blank has a ram, a blank holder, an annular die, a die holder, an insert and a plurality of ironing rings. The ram is centered about a longitudinal axis. The blank holder has an aperture through which the ram passes. The annular die is substantially axially aligned with the ram and adapted to allow the ram to pass therethrough. The die holder has a recessed portion adapted for receiving the annular die therein. The recessed portion has an annular, arcuate concave surface. The insert is located within the recess between the annular, arcuate concave surface and the annular die. The insert has a surface for supporting the annular die thereon opposite an annular, arcuate, convex surface in operative engagement with the annular, arcuate concave surface and swivelable thereon. The ironing rings are substantially axially aligned with the ram.

20 Claims, 4 Drawing Sheets

(56) References Cited

U.S. PATENT DOCUMENTS

| | | | | |
|---|---|---|---|---|
| 4,843,863 | A | 7/1989 | Grims et al. | |
| 4,926,669 | A | 5/1990 | Grims et al. | |
| 5,016,462 | A | 5/1991 | Grims et al. | |
| 5,692,409 | A | 12/1997 | Cheers et al. | |
| 5,740,692 | A * | 4/1998 | Dunwoody | 72/347 |
| 5,802,907 | A * | 9/1998 | Stodd | 72/336 |
| 7,107,811 | B2 | 9/2006 | Zauhar | |
| 2010/0313625 | A1 * | 12/2010 | Green | 72/409.19 |

OTHER PUBLICATIONS

Mandavian and Mai, Further Studies in Friction, Metallic Transfer and Wear Debris of Sliding Surfaces, p. 42, 1984.*

European Patent Office acting as International Searching Authority, International Search Report, mailed Mar. 19, 2014 for Application No. PCT/US2014/011067, Rexam Beverage Can Company as Applicant.

* cited by examiner

DRAW AND IRON APPARATUS

CROSS-REFERENCE TO RELATED APPLICATIONS

N/A

FEDERALLY SPONSORED RESEARCH OR DEVELOPMENT

N/A

TECHNICAL FIELD

The invention relates the production of can bodies for beverage containers; more particularly, the invention relates to a draw and iron apparatus for producing the sidewall and bottom profile of a can body for a two-piece beverage container.

BACKGROUND OF THE INVENTION

Two-piece cans are by far the most common type of metal containers used in the beer and beverage industry. They are usually formed of aluminum or tin-plated steel. The two-piece can consists of a first cylindrical can body portion having an integral bottom end wall and a second, separately-formed, top end panel portion which, after the can has been filled, is double-seamed thereon to close the open upper end of the container.

The can body is formed in a body making apparatus which draws and irons a metal blank (sometimes a preformed cup) into a deep, cylindrical cup. In a first step, the metal blank is fed into the apparatus, and a metal cup is formed in a drawing process. The cup typically has a sidewall diameter that is generally equal to the sidewall diameter of a finished can body. The sidewall at this point is generally unchanged from a sidewall of the metal blank and does not have a finished height. Additionally, the sidewall at this point has a thickness greater than that of a finished can body. In subsequent steps, the drawn cup is passed through ironing tools. These tools lengthen the cup sidewall without changing the diameter of the cylindrical sidewall. The metal needed to lengthen the sidewall comes from the thickness of the sidewall. Accordingly, as the cup passes through the ironing tools, a height of the cylindrical sidewall becomes greater (it is lengthened) and the thickness of the sidewall is decreased. In a final step, the bottom of the cup is shaped by a forming tool. The resultant unfinished can body has a cylindrical sidewall and a domed bottom profile. In a subsequent manufacturing step, the upper portion of the sidewall is necked in so that a reduced diameter neck is formed.

FIG. 1 shows a typical existing body making apparatus 10 which carries out the process described above. The apparatus 10 is centered about a longitudinal axis 50. A ram 14 and punch assembly 15 (collectively referred to herein as the ram) is axially aligned with the longitudinal axis and is generally adapted, as in sized and shaped, to pass through a central cavity 16 of the apparatus 10. The cavity 16 is at least partially formed by a plurality of annular tools, each having an aperture substantially axially aligned with the longitudinal axis 50.

A redraw sleeve 18 is positioned to the right of the ram 14 as shown in FIG. 1, assuming a conventional horizontally oriented apparatus 10 and a rightward thrust of the ram 14 through the cavity. The redraw sleeve 18 applies a force to a base or bottom portion of a blank. The ram 14 forces the blank through an annular redraw ring 22 to reduce the diameter of the cup and form the metal cup described previously. After the drawing step, the punch 12 maintains the diameter of the cup substantially constant as subsequent tools lengthen the sidewall as described above.

As an aside, the assumed orientation is for purposes of describing the prior art and, later, the invention, and in no way limits the invention to the orientation other than in terms of the relative positioning of the elements of the prior art and the invention.

The redraw ring 22 includes a carbide insert 26 which operatively engages the metal cup. The redraw ring 22 is supported in the apparatus 10 by a housing 28. The housing 28 includes a recess 30 in which the redraw ring 22 is supported in the apparatus 10.

Ironing rings 34 are located axially beyond the redraw ring 22. In the apparatus 10 shown, there are three ironing rings 34. Again, the purpose of the ironing tools 34 is to lengthen and thin the metal in the sidewall of the can body as the blank passes between the ironing tools 34 and the ram 14. Second rings 35 associated with the first two ironing rings 34 and located axially beyond are for guiding the ram 14.

A domer 38 is located at the end of the apparatus 10 after the ironing tools 34. The domer 38 is provided for reshaping the bottom profile of the can body after the sidewall has been fully formed.

One can body defect that is associated with the draw and iron process results in a top edge of the can body sidewall having unequal heights about the circumference of an open end of the can body opposite the reformed bottom end. This can be caused by unequal pressure applied by the redraw sleeve 18 on the metal blank against the redraw ring 22. Machine operators will often shim the apparatus to adjust the clearance between the ram 14 and the tooling 22,34 to counteract the effect of the uneven pressure.

For instance, in an attempt to achieve equal pressure around the blank, the operator will place shims in the tool pack. This can change the angle of the entire tool pack, including not only the redraw sleeve 18 and redraw ring 22, but also the ironing rings 34. The shim is typically placed at position A, as shown in FIG. 1. If the operator determines that there is excessive variation in the top edge of the container body height, he/she would add a shim at position A on FIG. 1 to correctly reposition the redrawing ring 22. However, the operator does not know the thickness of the shim that is needed. Therefore, he/she must use trial and error to determine the correct thickness of the shim.

One of the problems with shimming is that the operators must place them consistently. If there is a jam, the operators have to remove the tooling. When the operator replaces the tooling, he/she is supposed to ensure the can quality is good, and add shims as necessary. Moreover, the shims often do not stay in place and must be reinserted when variability arises. Additionally, shims are stuck to the apparatus using grease, and the shims fall out easily.

The present invention is provided to solve the problems discussed above and other problems, and to provide advantages and aspects not provided by prior draw and iron can body apparatuses of this type. A full discussion of the features and advantages of the present invention is deferred to the following detailed description, which proceeds with reference to the accompanying drawings.

SUMMARY OF THE INVENTION

One aspect of the present invention is directed to an apparatus for forming a container body from a metal blank. The apparatus comprises a ram, a blank holder, an annular die, an annular die holder, an insert, and a plurality of ironing rings. The ram is centered about a longitudinal axis. The blank holder has an aperture through which the ram passes. The annular die is substantially axially aligned with the ram and adapted to allow the ram to pass therethrough. The annular die holder has a recessed portion adapted for receiving the annular die therein. The recessed portion has an annular, arcuate concave surface. The insert is positioned within the recess and is located between the annular, arcuate concave surface and the annular die. The insert supports the annular die thereon opposite an annular, arcuate, convex surface in operative engagement with the annular, arcuate concave surface and swivelable thereon. The plurality of ironing rings are substantially axially aligned with the ram and positioned in sequential order.

The apparatus of the first aspect of the invention may include one or more of the following features, alone or in any reasonable combination. The annular die may have a support surface in operative engagement with a support surface of the insert. The support surface of the annular die may be substantially planar. The support surface of the insert may be substantially planar. The annular die may have a generally circumferential outer wall which is substantially at a right angle to the support surface. The annular, arcuate convex surface of the insert and the support surface of the insert may converge as the annular, arucate convex surface and the support surface extend radially outwardly wherein the annular, arcuate convex surface and the support surface merge at point adjacent a generally circumferential wall of the annular die holder. The apparatus may further comprise a locating ring located between the annular die holder and the generally circumferential outer wall of the annular die. The insert may be produced from a material having a Rockwell scale hardness less than a Rockwell scale hardness of the annular die. The insert may be integrally formed with the annular die to form a one-piece unit therewith.

A second aspect of the present invention is also directed to an apparatus for forming a container body from a metal blank. The apparatus comprises a ram, a blank holder, an annular die, an annular die holder, an insert, and a plurality of ironing rings. The ram is centered about a longitudinal axis. The blank holder has an aperture through which the ram passes. The annular die is substantially axially aligned with the ram and adapted to allow the ram to pass therethrough. The annular die holder has a recessed portion adapted for receiving the annular die therein. The recessed portion has an annular, arcuate concave surface. The insert is positioned within the recess and located between the annular, arcuate concave surface and the annular die. The insert supports the annular die opposite an annular, arcuate, convex surface. A means for reducing a coefficient of friction is between the annular, arcuate concave surface and the annular, arcuate convex surface of the insert. The plurality of ironing rings is substantially axially aligned with the ram.

The apparatus of the second aspect of the invention may include one or more of the following features, alone or in any reasonable combination. The annular die may have a support surface in operative engagement with a support surface of the insert. The support surface of the annular die may be substantially planar. The support surface of the insert may be substantially planar. The annular die may have a generally circumferential outer wall which is substantially at a right angle to the support surface. The annular, arcuate convex surface of the insert and the support surface of the insert may converge as the annular, arucate convex surface and the support surface extend radially outwardly wherein the annular, arcuate convex surface and the support surface merge at point adjacent a generally circumferential wall of the annular die holder. The apparatus may further comprise a locating ring located between the annular die holder and the generally circumferential outer wall of the annular die. The insert may be produced from a material having a Rockwell scale hardness less than a Rockwell scale hardness of the annular die. The means for reducing the coefficient of friction may comprise producing the annular, arcuate convex surface of the insert and the annular, arcuate concave surface of the insert from dissimilar metallic materials. The means for reducing the coefficient of friction may comprise a fluid pressure between the annular, arcuate convex surface of the insert and the annular, arcuate concave surface of the insert. The fluid pressure may be provided by a gas. The fluid pressure may be provided by a liquid. The insert may be integrally formed with the annular die to form a one-piece unit therewith.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
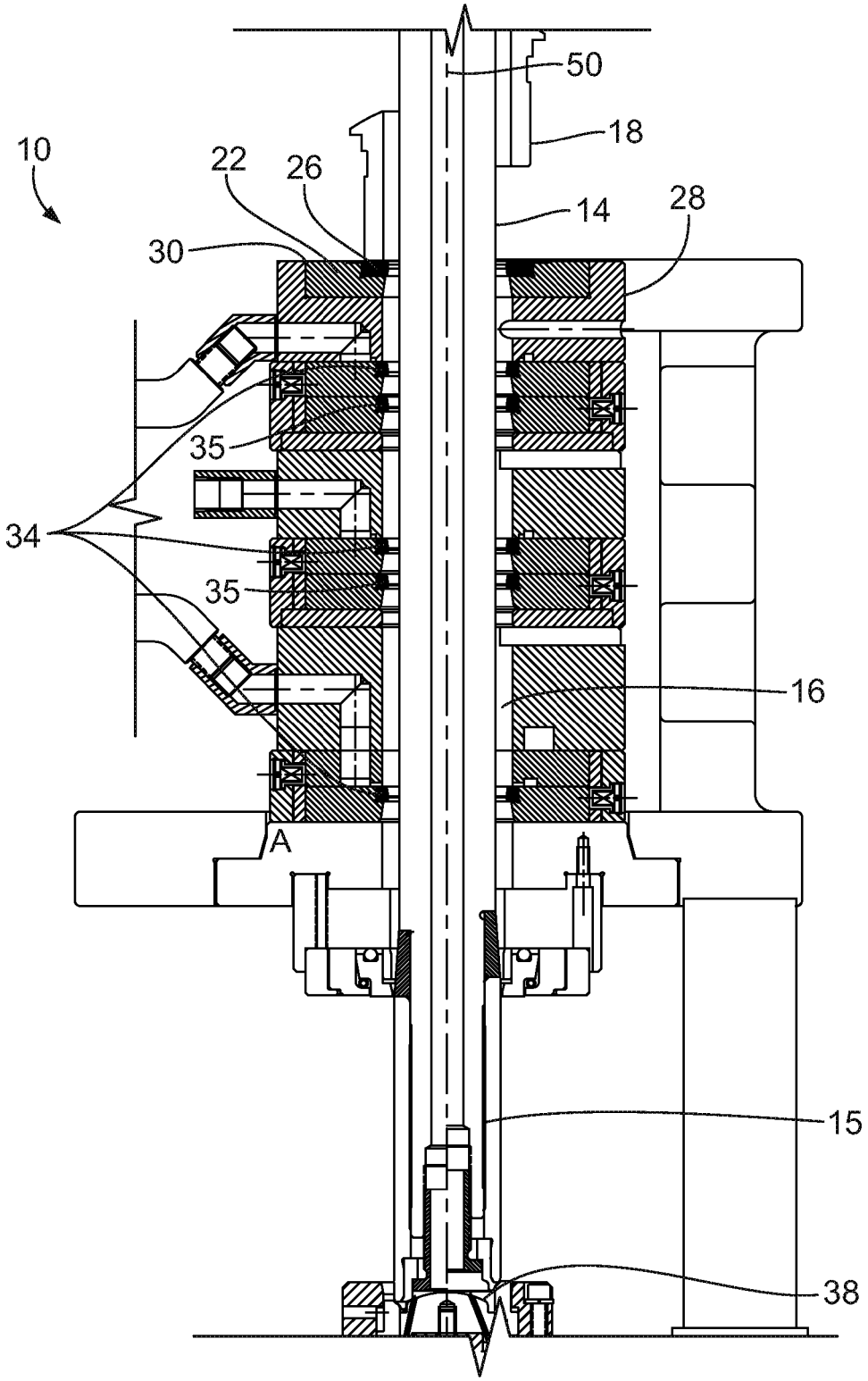
FIG. 1 (Prior Art)
FIG. 1 is cross-sectional side view of a prior art apparatus for drawing and ironing the sidewall of a container body.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a method and apparatus for drawing and ironing a metal blank into a semi-finished can body having a generally cylindrical sidewall, an open end, and an opposite enclosed bottom. The metal blank may be a flat sheet of metal strip, typically aluminum, or more preferably a shallow preformed cup formed from a flat metal sheet. More specifically, the invention described herein pertains to the first stage in such a draw and iron process wherein the metal blank undergoes a deep drawing step to produce a cylindrical sidewall having a diameter, substantially equal to the finished diameter of the semi-finished can body. Subsequent ironing steps elongate the sidewall without appreciable change in the diameter thereof.

The present invention eliminates the need for an operator to shim the tool pack as described in the Background. Accordingly, the invention saves time in setting up a can body making apparatus by eliminating the need for shimming as described above. The invention automatically positions the redraw ring 22 in the correct position. Thus, variability (length and waviness) of the sidewall along a top edge of the open end of the semi-finished can body is reduced or eliminated. This reduces metal waste as a variable top edge must be trimmed to make it uniform in subsequent manufacturing steps.

Figure 2:
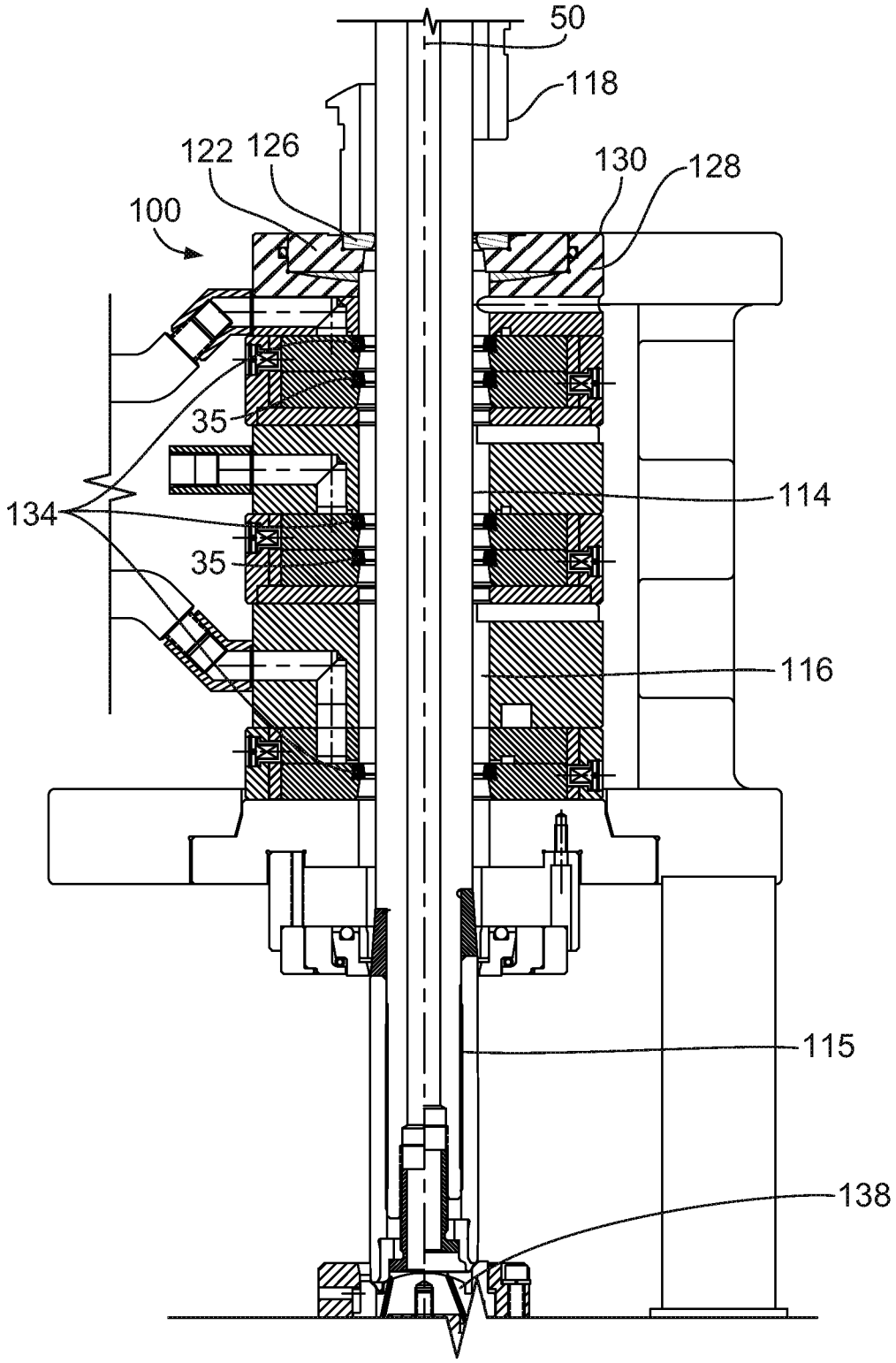
FIG. 2 is cross-sectional side view of an apparatus of the present invention.
Figure 3:
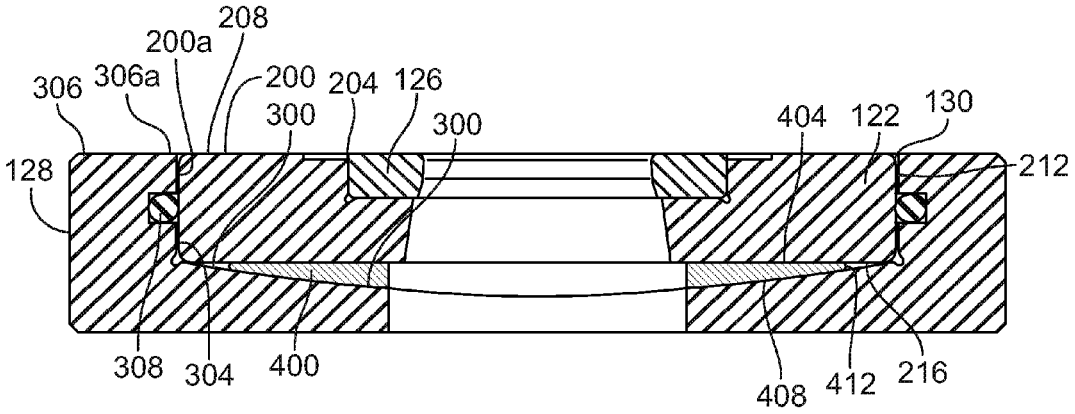
FIG. 3 is a cross-sectional side view of an annular die holder having a recess for receiving an annular insert and an annular die therein
Figure 4:
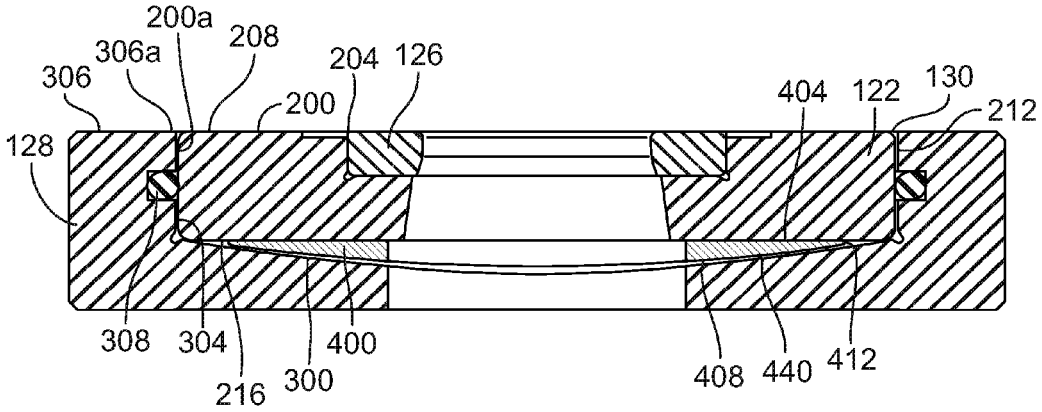
FIG. 4 is a cross-sectional side view of an annular die holder having a recess for receiving an annular insert and an annular die therein.
Figure 5:
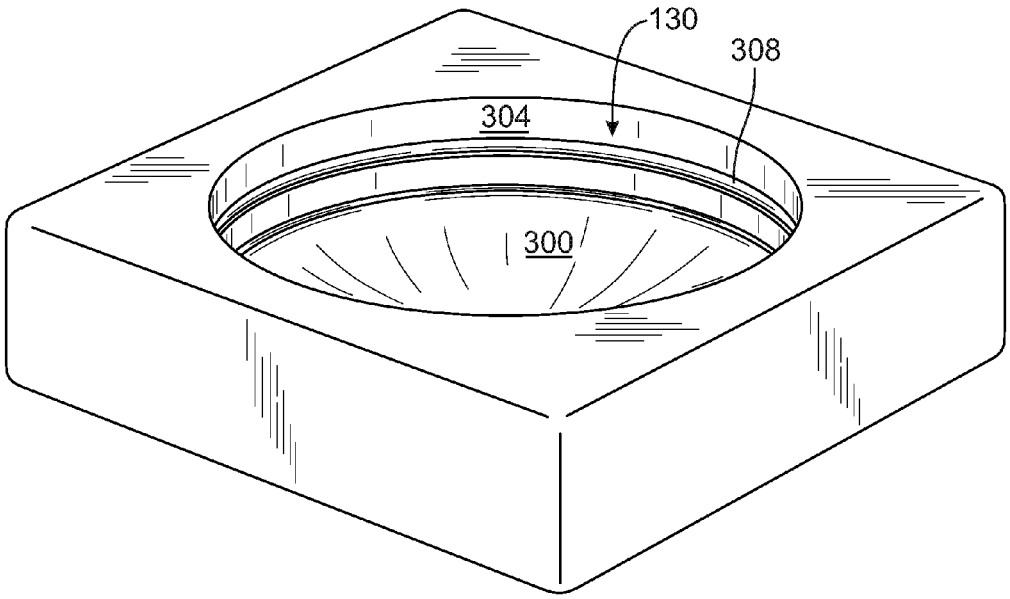
FIG. 5 is a perspective view of a die holder of the present invention.
Figure 6:
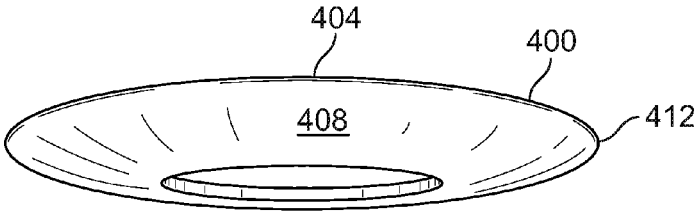
FIG. 6 is a perspective view of an insert for the die holder of the present invention.

Referring to the figures, a draw and iron apparatus 100 incorporating the principles of the present invent is illustrated in FIG. 2. The apparatus 100 which carries out the process described in the Background with the exception that it provides an improved redraw ring assembly as will be described in great detail below.

The apparatus 100 is centered about a longitudinal axis 50. A ram 114 and punch assembly 115 (collectively a ram) is axially aligned with the longitudinal axis and is generally adapted, as in sized and shaped, to pass through a central cavity 116 of the apparatus 100. The cavity 116 is at least partially formed by a plurality of annular tools, each having an aperture substantially axially aligned with the longitudinal axis 50.

A redraw sleeve 118 is positioned about the ram 114 an extent of the apparatus, assuming a conventional oriented apparatus 100 and axial thrust of the ram 114 through the cavity. The redraw sleeve 118 applies a force to a base or bottom portion of a blank. The ram 114 forces the blank through an annular redraw ring 122 to reduce the diameter of the cup and form the metal cup described previously. After the drawing step, the ram 114 maintains the diameter of the cup substantially constant as subsequent tools lengthen the sidewall as described above.

The assumed orientation for purposes of describing the present invention in no way limits the invention to the assumed orientation other than in terms of the relative positioning of the elements of the prior art and the invention. The inventors contemplate that the draw and iron apparatus could be rotated through a complete 360 degrees with the relative positioning remaining the same.

A first annular die or redraw ring 122 includes an annular carbide insert 126 which operatively engages the metal cup. The redraw ring 122 has an outer surface 200 including an annular cut out 204 in which the carbide insert is seated. The metal blank is drawn against the carbide insert 126 as the ram 114 forces the metal blank downwardly into the apparatus cavity 116. Radially outwardly from the cutout 204, the outer surface 200 has a substantially planar portion 208 which terminates at a circumferential wall 212 and is perpendicular thereto through a circumferential radiused corner. The wall 212 extends from the corner and terminates at a substantially planar bottom surface 216 and is perpendicular thereto through a circumferential radiused corner. The bottom surface 216 extends radially inwardly from the corner to an opening which is axially aligned with the longitudinal axis 50.

The redraw ring 122 is supported in the apparatus 100 by a housing or annular die holder 128. The die holder 128 includes a recess 130 in which the redraw ring 122 is supported in the apparatus 100. The die holder 128 of the present invention is substantially bowl-shaped wherein the recess 130 has an inwardly concave surface 300 and a center opening axially aligned with the longitudinal axis 50. The inwardly concave surface 300 is preferably annular and arcuate, more preferably annular and semi-spherical or a truncated sphere. An annular, vertical circumferential wall 304 extends from a radially outermost edge of the concave surface 300 and terminates at a generally planar surface 306. An O-ring or locating ring 308 may be seated within a circumferential recess within the die holder 128 or the redraw ring 122 to position the O-ring 308 between the wall 304 of the holder 128 and the wall of the redraw ring 122 to aid in centering the redraw ring 122.

An insert 400 is seated within the recess 130. The insert 400 is located within the recess 130 between the inwardly concave surface 300 and the redraw ring 122. Accordingly, the redraw ring 300 is supported in the recess 130 by the insert 400, preferably atop the insert 400 as shown. The insert 400 has a surface 404 on which the redraw ring 122 sits or is supported. This surface 404 is generally planar. Opposite the surface 404 is an outwardly convex surface 408. The convex surface 408 operatively engages the concave surface 300 of the recess 130. It follows that the convex surface 408 has a complimentary shape to the concave surface 300, in this case annular and arcuate, preferably semi-spherical or a section of a sphere. Thus, in the insert 400, the annular, arcuate convex surface 408 and the surface 404 converge as the annular, arcuate convex surface 408 and the surface 404 extend radially outwardly wherein the annular, arcuate convex surface 408 and the surface 404 merge at a point 412 adjacent the generally circumferential wall 304 of the annular die holder 128. The point 412 preferably has a radius of curvature to limit wear on the wall 304.

The insert 400 allows the redraw ring 122 to achieve a swiveling motion within the die holder 128. The clearances between the tooling restrict the swiveling motion to a desirable degree. For example, a desirable amount of movement of the redraw ring 122 relative to the die holder 128 may be no more than about 0.0019 ins (0.05 mm), and an undesirable amount of the such movement may be more than 0.0035 ins (0.89 mm), measured as a maximum height of a radially outer edge 200*a* of the outer surface 200 of the redraw ring 122 above a radially inner edge 306*a* of the surface 300 of the die holder 128. Thus, it is an aspect of the invention to restrict such movement and height differential to between 0.0019 ins and 0.0035 ins.

The swiveling motion allows the redraw ring 122 to self-correct relative to the ram 114 and the redraw sleeve 118 to adjust the center position of the redraw ring 122 and provide automatic centering of the redraw ring 122 without the use of shims as discussed above.

Further, the insert 400 is produced from a material that is dissimilar from the material used to produce the die holder 128. For example, the die holder 128 may be produced from AISI-H13 tool steel whereas the insert 400 is produced from a softer material, such as a brass or bronze alloy, for example the brass and bronze alloys produced by Ampco Metals, such as Ampco 18. Generally, the insert 400 will have a hardness on the Rockwell C scale that is less than a hardness of the redraw ring 122 and the die holder 128. Additionally, if the insert 400 was produced from a like tool steel to that of the die holder 128, the inventors believe that the coefficient of friction between the parts produced from the tool steel would be too high. Therefore, one aspect of the invention is to reduce the coefficient of friction between the insert 400 and the die holder 128, preferably by varying the material used to produce the insert 400, for example producing it from a brass alloy, although the coefficient of friction may also be lowered by other means such as polishing the engagement surfaces of the insert 400 and the die holder 128 or by providing a fluid pressure between the engagement surfaces such that the engagement surfaces ride or float on a lubricating, coefficient of friction reducing film or fluid pressure 440. However, the preferred method of reducing friction has the advantage of not requiring a source of fluid pressure or precise polishing of the engagement surfaces to reach a desired amount of movement of the insert 400 relative to the die holder 128.

A group ironing tools 134 are located axially beyond/downstream the redraw ring 122. In the apparatus 100 shown, there are three ironing tools 134. In a process well known in the art of beverage can body manufacturing, the ironing tools 134 are used to lengthen and thin the metal in the sidewall of the can body as the blank passes between the ironing tools 134 and the ram 114.

A domer 138 is located below the ironing tools 134. The domer 138 is provided for reshaping the bottom profile of the can body after the sidewall has been fully formed.

Figure 7:
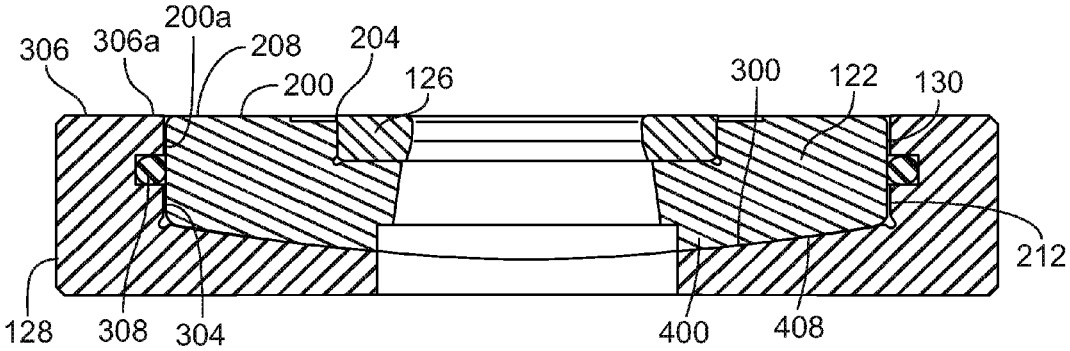
FIG. 7 is a perspective view of an alternative embodiment of the inset of the present invention integrally formed with an annular die to form a one-piece unit.

FIG. 7 shows an alternative arrangement wherein the insert 400 is integrally formed with the redraw ring 122 to form a one-piece unit therewith. In other words, the support surfaces 216,404 of the redraw ring 122 and the insert 400 are eliminated or merged as to be non-existent.

The terms "first," "second," "upper," "lower," "top," "bottom," "above," below," etc. are used for illustrative purposes to associate relative positioning of elements to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. An apparatus for forming a container body from a metal blank comprising:

a ram centered about a longitudinal axis;

a blank holder having an aperture through which the ram passes;

an annular die substantially axially aligned with the ram and adapted to allow the ram to pass therethrough;

an annular die holder having a recessed portion in which the annular die resides, the recessed portion having an annular, arcuate concave surface;

an insert in the recess located between the annular, arcuate concave surface and the annular die, the insert separable from the annular die and supporting the annular die opposite an annular, arcuate, convex surface in operative engagement with the annular, arcuate concave surface and swivelable thereon;

a plurality of ironing rings substantially axially aligned with the ram.

2. The apparatus of claim 1 wherein the annular die has a support surface in operative engagement with a support surface of the insert.

3. The apparatus of claim 2 wherein the support surface of the annular die is substantially planar.

4. The apparatus of claim 3 wherein the support surface of the insert is substantially planar.

5. The apparatus of claim 4 wherein the annular die has a generally circumferential outer wall which is substantially at a right angle to the support surface.

6. The apparatus of claim 5 wherein the annular, arcuate convex surface of the insert and the support surface of the insert converge as the annular, arcuate convex surface and the support surface extend radially outwardly wherein the annular, arcuate convex surface and the support surface merge at a point adjacent a generally circumferential wall of the annular die holder.

7. The apparatus of claim 6 further comprising:

a ring located between the annular die holder and the generally circumferential outer wall of the annular die.

8. The apparatus of claim 1 wherein the insert is produced from a material having a Rockwell scale hardness less than a Rockwell scale hardness of the annular die.

9. The apparatus of claim 1 further comprising:

a coefficient of friction reducer between the annular, arcuate concave surface and the annular, arcuate convex surface of the insert.

10. The apparatus of claim 9 wherein the annular die has a support surface in operative engagement with a support surface of the insert.

11. The apparatus of claim 10 wherein the support surface of the annular die is substantially planar.

12. The apparatus of claim 11 wherein the support surface of the insert is substantially planar.

13. The apparatus of claim 12 wherein the annular die has a generally circumferential outer wall which is substantially at a right angle to the support surface.

14. The apparatus of claim 13 wherein the annular, arcuate convex surface of the insert and the support surface of the insert converge as the annular, arcuate convex surface and the support surface extend radially outwardly wherein the annular, arcuate convex surface and the support surface merge at a point adjacent a generally vertical circumferential wall of the annular die holder.

15. The apparatus of claim 14 further comprising:

a ring located between the annular die holder and the generally circumferential outer wall of the annular die.

16. The apparatus of claim 9 wherein the coefficient of friction reducer comprises producing the annular, arcuate convex surface of the insert and the annular, arcuate concave surface of the insert from dissimilar metallic materials.

17. The apparatus of claim 16 wherein the insert is produced from a material having a Rockwell scale hardness less than a Rockwell scale hardness of the annular die.

18. The apparatus of claim 9 wherein the coefficient of friction reducer comprises a fluid pressure between the annular, arcuate convex surface of the insert and the annular, arcuate concave surface of the insert.

19. The apparatus of claim 18 wherein the fluid pressure is provided by a gas.

20. The apparatus of claim 19 wherein the fluid pressure is provided by a liquid.

* * * * *